United States Patent [19]

Eary, Sr.

[11] 3,946,452

[45] Mar. 30, 1976

[54] ADJUSTABLE HEAD AND SHOULDER REST

[76] Inventor: George D. Eary, Sr., Rte. 6, Box 264, Hagerstown, Md. 21740

[22] Filed: Mar. 17, 1975

[21] Appl. No.: 559,009

[52] U.S. Cl. ..... 5/327 B; 5/338; 297/392

[51] Int. Cl.[2] ..... A47C 21/00; A47C 7/32

[58] Field of Search ..... 5/327, 327 B, 338, 91; 128/76 R; 297/392; 269/328

[56] References Cited

UNITED STATES PATENTS

| | | | |
|---|---|---|---|
| 245,639 | 8/1881 | Lay | 297/410 X |
| 247,208 | 9/1881 | Miller | 297/410 X |
| 1,134,720 | 4/1915 | Bradley | 297/393 X |
| 2,688,142 | 9/1954 | Jensen | 5/327 B |
| 3,188,079 | 6/1965 | Boetcker | 297/391 |
| 3,243,828 | 4/1966 | McCarty | 5/338 |
| 3,608,103 | 9/1971 | Seid | 5/327 B |
| 3,608,964 | 9/1971 | Earl | 5/338 |

*Primary Examiner*—Paul R. Gilliam
*Assistant Examiner*—Andrew M. Calvert

[57] ABSTRACT

An adjustable head and shoulder rest is disclosed which is intended primarily for supporting the upper body while lying face down with the head vertically positioned or turned to either the left or right side to any degree up to approximately forty five degrees. A head or face rest consisting of either two or three separate members providing a variation of open areas for the eyes, nose and mouth, together with movable right and left shoulder support members permitting adjustment to differing body dimensions and allowing proper weight distribution, ease of unrestricted breathing and body comfort.

1 Claim, 13 Drawing Figures

ADJUSTABLE HEAD AND SHOULDER REST

BACKGROUND OF THE INVENTION

1. Field of the invention

This invention relates to a support for the upper part of the body. More particularly it relates to a device which enables one to lie comfortably face-down wherein the head and shoulders are cradled in a manner providing for a comfortable distribution of weight and which enables easy, unrestricted breathing.

Many individuals have difficulty in sleeping or resting comfortably in a face-down position. This may be required during surgery or in post operation recovery. This mode of repose is helpful to ladies who have had their hair coiffeured and wish to preserve the results of their visit to the beauty parlor as long as possible. Likewise, sleeping face-down would avoid any discomfort due to the presence of hair curlers. In addition, sunbathers will find this invention useful.

2. Description of Prior Art

A number of devices have been patented which are stated to enable one to lie face-down in comfort. While these devices do enable one to lie face-down in a greater degree of comfort than they would have in their absence, they are either not adjustable to take care of differing body dimensions or the desires of the occupant, or are adjustable in a limited manner, or else do not properly support the head and shoulders in the best possible manner.

SUMMARY OF THE INVENTION

This invention consists of a base support having attached thereto a pair of spaced apart resilient shoulder supports which may be adjusted laterally and longitudinally relative to each other and to the head support, allowing the distance between the head support and the shoulder supports to be varied. Fastened to the base and spaced longitudinally from the shoulder supports and equidistant therefrom is a resilient face support consisting of three separate rests or movable members providing a number of variations of open areas for the eyes, nose and mouth. The face support may be tilted about an axis parallel to the base and may be raised and lowered. Also, the face support may be rotated about an axis parallel to the base which will allow the user to rest their face on the right or left side.

DESCRIPTION OF PREFERRED EMBODIMENTS

Figure 1:
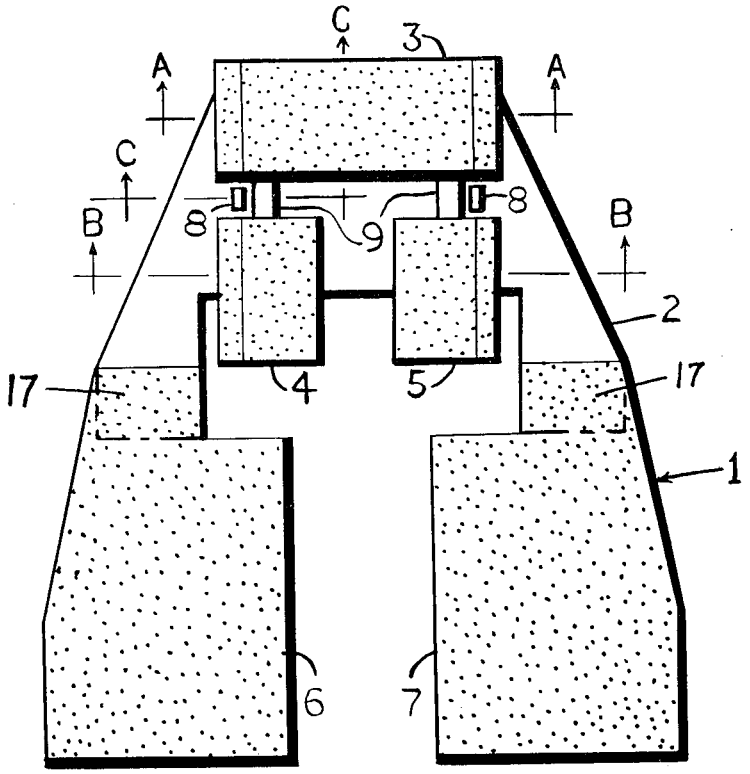
FIG. 1 is a plan view of one embodiment of the adjustable head and shoulder rest.

FIG. 1 shows a head and shoulder rest designated generally as 1, which has a base 2. Base 2 is made of flat and relatively thin material having a sufficient rigidity to serve as a support for the head support elements to be attached thereon. Suitable materials for this purpose may be aluminum or other sheet metal, plywood, composition board, various resin-fiber glass laminates, etc. Attached to base 2 at it's rearward portion are shoulder rests 6 and 7, attached by fastening tape 17, such as Velcro tape. Near the middle of base 2 are mounted resilient face supports 3, 4 and 5 and fastened to their undersides are rigid and relatively thin bases 10, 18 and 18 respectively, shown in FIGS. 2 and 4 and may be of the same composition as base 2. Shoulder rests 6 and 7 as well as face rests 3, 4 and 5 are made from a resilient material such as foam rubber, polyurethane foam or padding, for example, and may be covered by cloth or plastic. Alternately, they may be made of inflatable bladders of suitable configuration which can be inflated with air or hot or cold liquids to the desired firmness and temperature prior to use.

Figure 2:
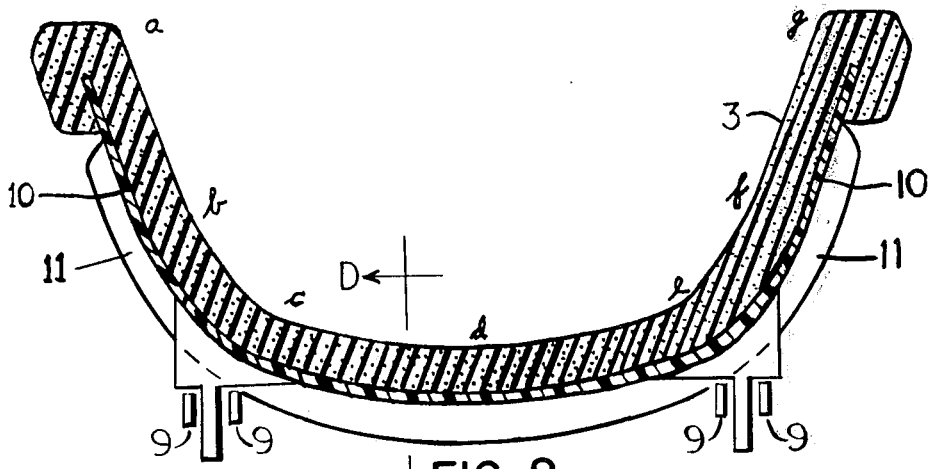
FIG. 2 is a sectional view of forehead rest 3 along line A—A of FIG. 1.
Figure 8:
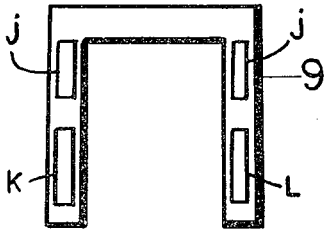
FIG. 8 is a plan view of support 9.

FIG. 2 is a sectional view along line A—A of FIG. 1 showing the forehead rest 3, thin base 10 and stiffener 11 which forms forehead resting surface noted with letters "*a*" through "*g*". Segments "*a*" to "*b*" and "*f*" to "*g*" are straight, approximately one and one half inches long and on an approximately twenty degree angle from the vertical. Segments "*b*" to "*c*" and "*e*" to "*f*" form approximately 2 inch radii. Segment "*c*" to "*e*" forms an approximately 6 inch radius. The horizontal distance from "*a*" to "*g*" is approximately 6 inches and the depth from that horizontal line to the lowest area at "*d*" is approximately 2½ inches. At the lower left and lower right is shown how support 9 mates with head rest structure and can be fastened permanently together as with an adhesive or made removable by adding thumb screws to threaded holes through the outside portions of the left and right sides of support 9. (Alternate method of fastening with thumb screws not shown). Mounting slots in support 9 are shown in FIG. 8 as "*j*" and "*j*."

Figure 3:
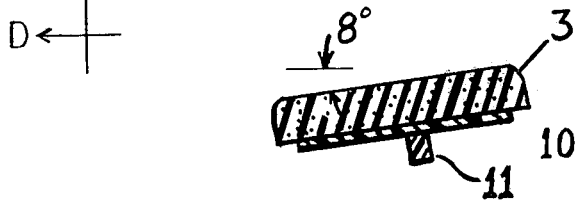
FIG. 3 is a sectional view of forehead rest 3 along line D—D of FIG. 2.

FIG. 3 is a sectional view along line D—D of FIG. 2 showing a downward taper toward cheek rests 4 and 5 and of an approximate angle of eight degrees. Said taper extends from point "*c*" to "*e*" shown in FIG. 2.

Figure 4:
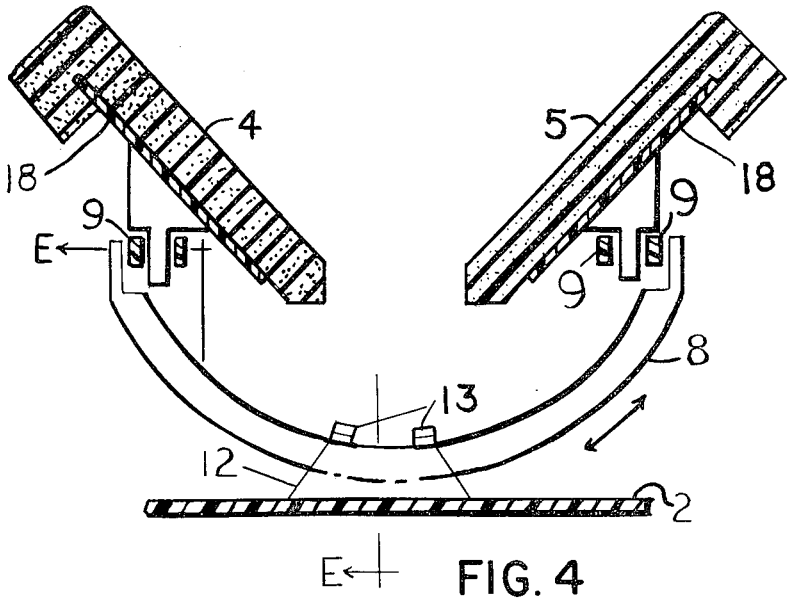
FIG. 4 is a sectional view of left and right cheek rests 4 and 5 and support members 2, 8, 9, 12 and 13 along line B—B of FIG. 1.

FIG. 4 is a sectional view along line B—B of FIG. 1. Resting surfaces of rests 4 and 5 are approximately ninety degrees to each other and the lowest portions are approximately two inches apart. Taken in conjunction with FIG. 1 and FIG. 8 it is apparent that rest 4 is located in slot "*k*" and rest 5 is located in slot "L" of support 9 and may be fastened thereto as by an adhesive or may be secured at a variation of locations by a thumb screw at each side, in one of a series of threaded holes through outside portions of support 9 along the length of slots "*k*" and "L." (Thumb screws omitted for clarity). Locations for optional threaded holes shown in Figure by dots. Such embodiment allows rests 4 and 5 to be secured in a position touching forehead rest 3 or any distance up to one and one half inches away from forehead rest 3 as is shown in FIG. 1. FIG. 4 makes apparent also that the user may place his face vertically, mouth down, or rest on either the right or left side of his face at any angle up to approximately 45° by rotating support 8 clockwise or counter-clockwise.

Figure 5:
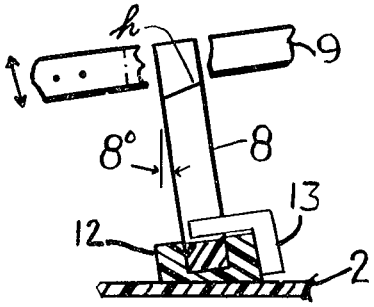
FIG. 5 is a sectional view along line E—E of FIG. 4 showing structural support members.

FIG. 5 is a sectional view along line E—E of FIG. 4 showing supports 8, 9 and 12 and clamp 13 mounted on base 2. Support 9 is shown broken and tab beneath rest 4 is omitted for clarity. Support 9 may be rotated about a horizontal axis raising rest 3 while simultaneously lowering rests 4 and 5, which assures proper distribution of head weight between forehead and cheek rests. Surface of support 8 indicated by "*h*" allows rest 3 to be horizontal to or higher than rests 4 and 5 at all times. Also shown, support 8 is approximately 8° from vertical to allow weight of head to be applied properly (90°) to the support. This is desireable as the user's head and shoulders are elevated on an approximately 8° incline.

Figure 6:
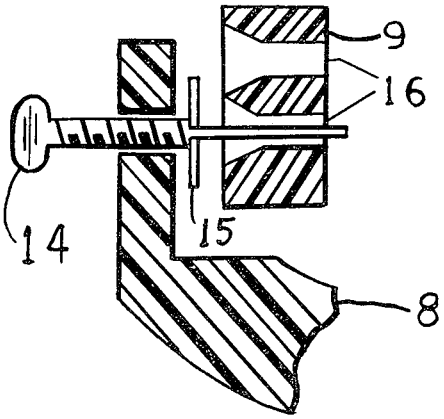
FIG. 6 is a sectional view along line C—C of FIG. 1 showing attachment of supports 8 and 9.

FIG. 6 is a sectional view along line C—C of FIG. 1 showing attachment of supports 8 and 9. Thumb screw 14 can be placed as shown into lower hole 16 in support 9 to raise rests 3, 4 and 5. To lower rests 3, 4 and 5 place thumb screw 14 into higher hole 16 in support 9. Also, the support point can be moved closer to or further from rest 3 by choosing one of a pattern of holes, not shown, along the length of the legs of support 9 in the solid portion between slots "*j*" and "*k*" and slots "*j*" and "*L*", in FIG. 8. Considering FIG. 4 in conjunction with FIG. 6 it becomes apparent that by threading in right and left thumb screws 14, rests 4 and 5 move closer together. By threading said thumb outward, the spring character of support 9 forces the rests 4 and 5 apart, allowing the user to adjust the distance between cheek rests 4 and 5 for optimum comfort according to his/her facial features. The right side is typical for shown left side.

Figure 7:
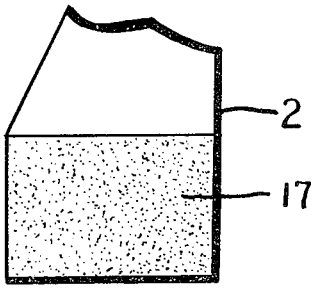
FIG. 7 is a plan view of the lower left portion of base 2 with shoulder rest 6 omitted, showing attachment thereto.

FIG. 7 is a plan view showing the lower left portion of base 2 with fastening tape 17, such as Velcro, attached by adhesive to an approximately 2 inch by 3 inch rectangular area. To the bottom area of shoulder rest 6 is attached, where shown in FIG. 1, a 2 inch by 3 inch rectangular piece of mating tape. When removed, shoulder rests can be positioned or rotated as desired and with use of moderate pressure mating tapes engage and hold rest 6 firmly. Right rest 7 is typical.

FIG. 8 is a plan view of support 9 showing slots into which head rests 3, 4 and 5 are positioned.

Figure 9:
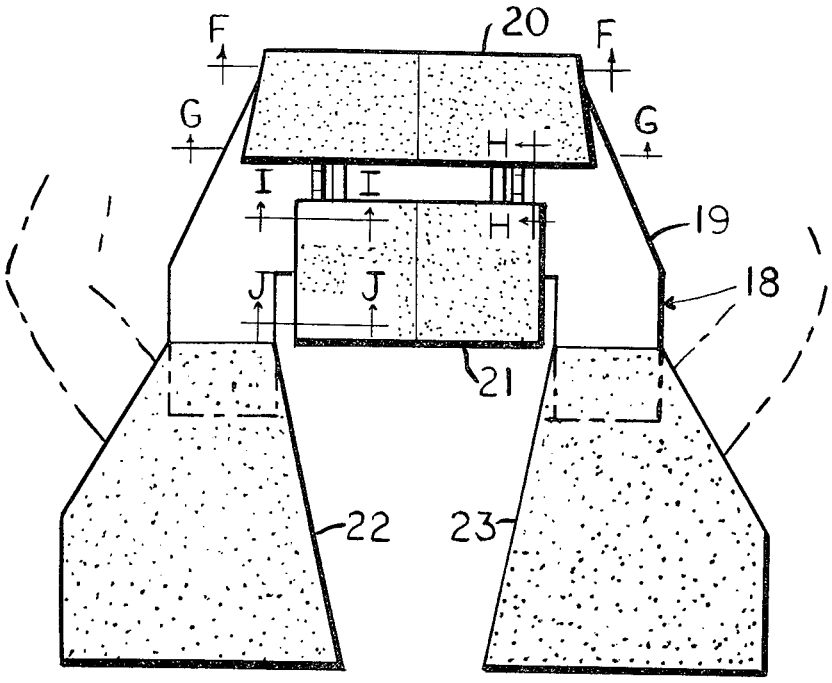
FIG. 9 is a plan view of another embodiment of the adjustable head and body rest.

FIG. 9 is a plan view of another embodiment of the adjustable head and shoulder rest with which the head is supported at approximately a forty five degree angle to the right or left. This embodiment is designated generally as 18 and has a base 19 made of similar material as base 2 and with same shoulder rest attachment provisions as shown in FIG. 1. Forehead rest 20 and lower face rest 21 are mounted on thin bases 24 and 26 respectively and are made of approximately one sixteenth thick material similar to bases 10 and 18 of FIG. 1. Said bases are supported and uniquely configured by frame 24 as outlined in descriptions of and shown in FIGS. 10, 11 and 12.

Figure 10:
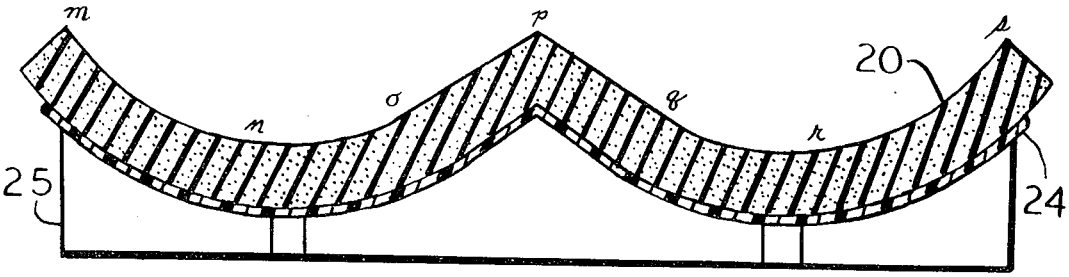
FIG. 10 is a sectional view along lines F—F and G—G of FIG. 9.

FIG. 10 is a sectional view along lines F—F and G—G of FIG. 9 showing the forehead rest 20, thin base 24 and frame 25. The forehead resting surfaces configure as noted with letters "*m*" through "*s*". Along lines F—F and G—G, segments "*m*" to "*n*" and "*r*" to "*s*" form a radius of approximately 6 inches; segments "*n*" to "*o*" and "*q*" to "*r*" form a radius of approximately 2 inches; segments "*o*" to "*p*" and "*p*" to "*q*" are straight lines and on an angle of approximately 20° from the horizontal formed by points "*m*," "*p*" and "*s*." The straight line segments are approximately 1 inch long along line F—F and 1½ inches long along line G—G resulting in an overall horizontal length from "*m*" to "*s*" along line F—F of approximately 8½ inches and along line G—G of 9½ inches. From the same horizontal line "*m*" to "*s*", the depth to "*n*" and "*r*" is approximately 1½ inches.

Figure 11:
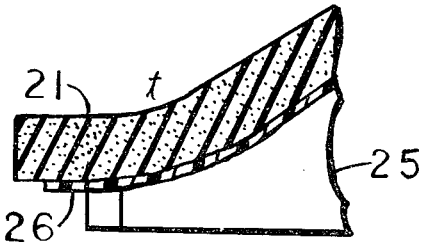
FIG. 11 is a sectional view along line I—I of FIG. 9.

FIG. 11 is a sectional view along line I—I of FIG. 9 showing the left upper corner of the face rest 21, thin base 26 and frame 25 which configures a resting surface same as "*n*" to "*p*" of FIG. 10, allowing a low area from point indicated by "*t*" to the outside edge of the face rest. This produces a depressed area into which the cheek bone of the user is nested. Right upper corner is typical of shown upper left corner.

Figure 12:
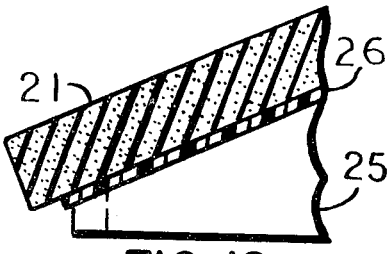
FIG. 12 is a sectional view along line J—J of FIG. 9.

FIG. 12 is a sectional view along line J—J of FIG. 9 showing lower left corner of the lower face rest 21, thin base 26 and frame 25 which configures a resting surface at an approximate angle of fifteen degrees below the horizontal thereby producing a relatively raised area to nest the side of the user's chin. The right lower corner is typical of the straight surface shown of the left lower corner.

Figure 13:
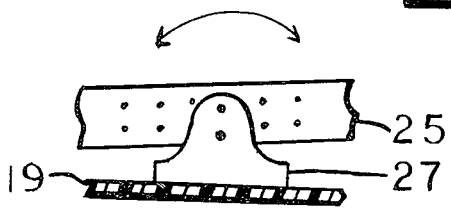
FIG. 13 is a sectional view along line H—H of FIG. 9.

FIG. 13 is a sectional view along line H—H of FIG. 9 showing base 19, right side support 27 and frame 25. A pattern of unthreaded one sixteenth diameter holes exist in frame 25 as indicated by dots and two one sixteenth diameter holes exist in support 27, also indicated by dots. By inserting two snug fit pins through supports 27 and frame 25, one on the left and one on the right side, face rests 20 and 21 will be suspended at a desireable heighth and will rotate as indicated by arrow, allowing weight of the head to be equalized between the forehead and lower face rests. Support point can be moved closer to or further from rest 20 and choice of a proper combination of holes will raise or lower head rests 20 and 21 as desired by user.

Fore head rests 3 and 20 are approximately three inches wide. Cheek rests 4 and 5 measure approximately three by 4 inches and lower face rest 21 measures approximately 4 inches by 6 inches. The thickness of all face rests may vary from approximately 1 to 2 inches and the thickness of all shoulder rests may vary from 3 to 6 inches. As shown, shoulder rests may be shaped differently but generally, each contain approximately 55 square inches of resting surface.

What is claimed:

1. An adjustable rest for the head and shoulder portion of the human body comprising:

a. a base member, b. a pair of laterally adjustable spaced apart resilient shoulder members attached to, but not resting on said base member adapted to support the shoulders and upper chest of a human body in facedown position on the said rest, c. a face member having three distinctly separate, movable and removeable members, a larger one for the forehead, a smaller one for the left cheek extending below the left side of the chin, and a similar smaller one for the right cheek extending below the right side of the chin, d. the face member being spaced longitudinally and generally about equidistant from each of the shoulder members, so that the head and shoulders of the human body in face-down position may be comfortably supported by said face and shoulder members, e. said face member having three separate and moveable portions providing a near unlimited number of variations of open areas adaptable to receive the eyes and/or nose and mouth portion of a human face when in face-down position on the face member, f. means for adjustably raising and lowering the face member, g. means for permitting rotational motion of said face member about a transverse axis parallel to the base member, h. means for varying the distance between the two cheek members of the face rest providing capability to support different face widths, i. means for rotating the face member about a longitudinal axis (from cheek rests to center of forehead rest) allowing user to rest on the left or right side of the face at any angle up to approximately 45°.

* * * * *